United States Patent [19]

Haraden et al.

[11] 4,405,877

[45] Sep. 20, 1983

[54] VARIABLY POSITIONAL LAMP HOLDER ASSEMBLY

[75] Inventors: Thomas Haraden, Ipswich; Harold L. Hough, Beverly, both of Mass.

[73] Assignee: GTE Products Corporation, Stamford, Conn.

[21] Appl. No.: 329,908

[22] Filed: Dec. 11, 1981

[51] Int. Cl.[3] ..... H01J 5/48; H01J 5/50

[52] U.S. Cl. ..... 313/318; 339/8 PS; 339/68

[58] Field of Search ..... 313/318, 324, 49; 339/1 L, 2 L, 2 A, 6 R, 6 A, 8 PS, 68, 112 R; 362/362, 370, 373, 410, 412, 413, 414, 417, 418, 216; 336/55, 59; 315/53, 57, 58; D26/42, 93

[56] References Cited

U.S. PATENT DOCUMENTS

| | | | |
|---|---|---|---|
| 1,562,649 | 11/1925 | McClatchie | 339/68 |
| 1,572,119 | 2/1926 | McClatchie | 339/68 |
| 1,609,230 | 11/1926 | Warner | 339/68 |
| 1,633,025 | 6/1927 | Kranz | 339/8 PS |
| 1,822,985 | 9/1931 | Wright | 339/8 PS |
| 2,542,935 | 2/1951 | McElroy | 339/8 PS |

*Primary Examiner*—Alfred E. Smith
*Assistant Examiner*—Robert E. Wise
*Attorney, Agent, or Firm*—William H. McNeill

[57] ABSTRACT

A variably positional lamp holder has a base that provides for limited rotational movement relative to the lamp holder body to allow projecting arms on the body to be positioned to allow mounting freedom for a harp.

6 Claims, 6 Drawing Figures

VARIABLY POSITIONAL LAMP HOLDER ASSEMBLY

TECHNICAL FIELD

This invention relates to lamp holder assemblies and more particularly to such assemblies employed for fitting circular fluorescent lamps to incandescent sockets.

BACKGROUND ART

Because of the increasing cost of electrical energy the substitution of initially costlier, but more energy efficient, flourescent lamps in place of incandescent lamps has become practical. A prime candidate for this substitution is the circular fluorescent lamp, primarily because of its more compact size when compared with the more typical elongated fluorescent lamp.

Common to most structures employed for this purpose are a central hub which can include a ballast and having one or more projecting arms having a terminal end formed to hold the lamp. Exemplary of such assemblies are the devices shown in U.S. Pat. Nos. 2,298,961; 2,817,004; Des. 259,961; and 4,278,911. Lamp holders of such designs function well enough when inserted in a bare wall socket or similar unit; however, when mounted in a lamp which employs a harp to support a shade it is often found that when the assembly is firmly screwed in place the projecting arms may interfere with replacement of the harp. To rectify this condition it is necessary to partially unscrew the assembly, which can result in a loose mechanical fit in the socket and a poor electrical connection.

DISCLOSURE OF THE INVENTION

It is, therefore, an object of the invention to obviate the disadvantages of the prior art.

It is another object of the invention to enhance the fitting of fluorescent lamps to incandescent sockets.

These objects are accomplished, in one aspect of the invention, by a variably positional lamp holder assembly comprised of a housing having a plurality of radial arms attached thereto and transversely projecting therefrom. The terminal ends of the arms remote from the housing are formed to receive and hold a circular lamp. The housing has a lower portion that carries an electrically conductive base, said base being fixed to the housing in a manner to allow a limited amount of rotational movement of the base relative to the lower portion.

By employing this invention the lamp holder assembly can be firmly seated in its associated socket. Then, if necessary to avoid interference between the arms of the holder and the harp, the holder can be rotated in a reverse direction to avoid the interference while the base remains effectively seated in the socket.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 2:
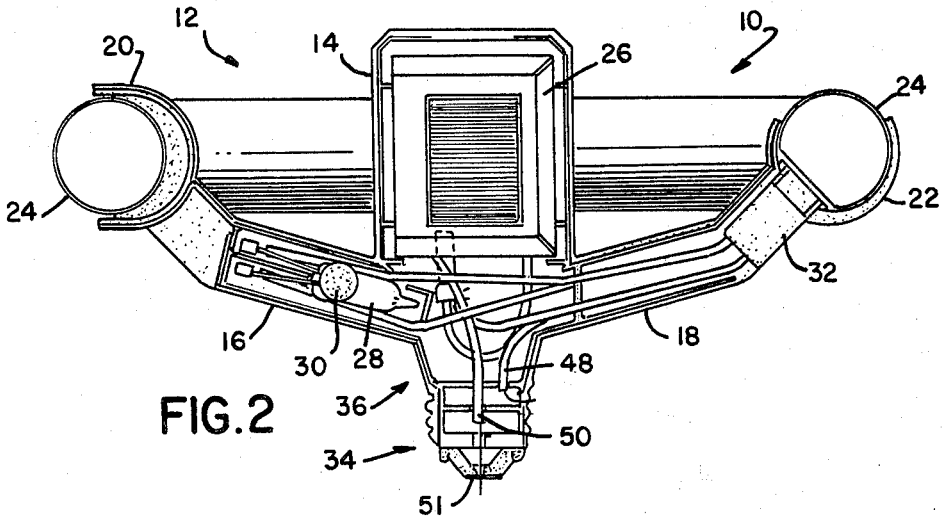
FIG. 2 is an elevational, sectional view thereof taken along the line 2—2 of FIG. 1.
Figure 1:
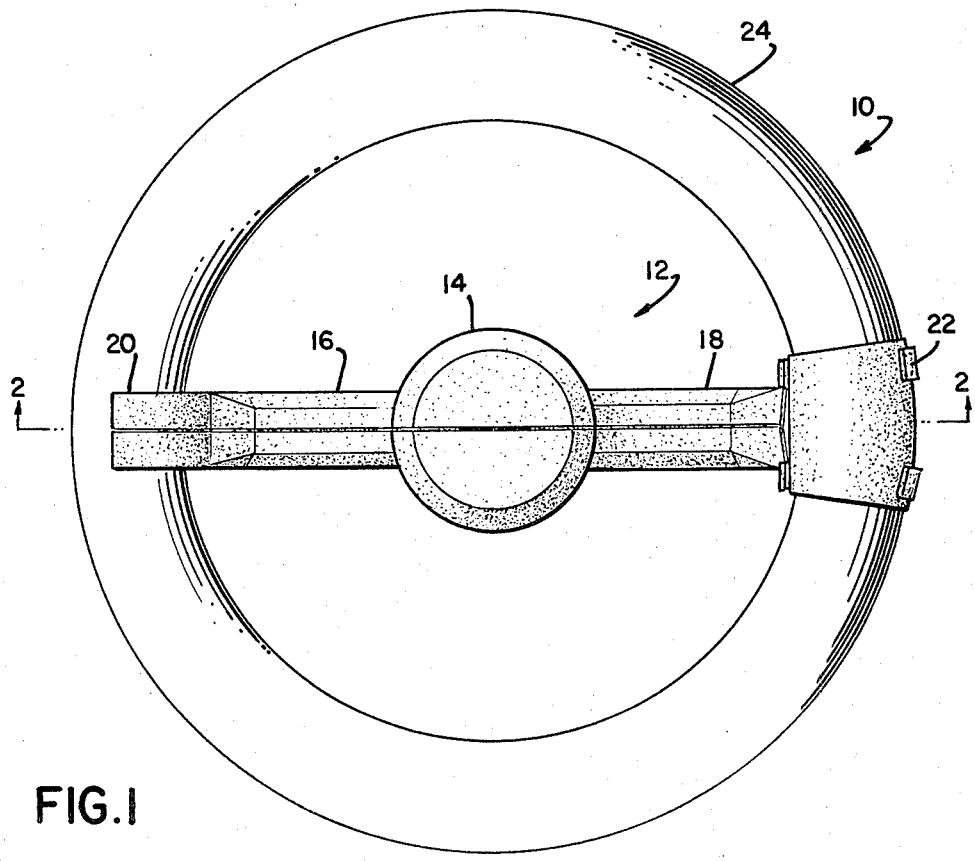
FIG. 1 is a plan view of a lamp holder assembly.
Figure 3:
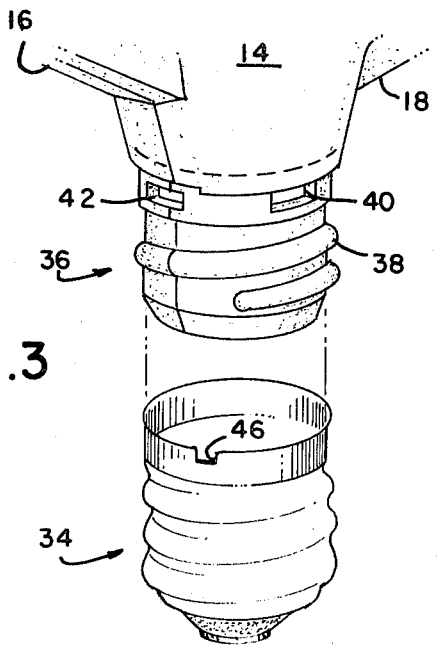
FIG. 3 is an enlarged, exploded perspective view of the base of the invention.

Referring now to the drawings with greater particularity, there is shown in FIG. 1 a variably positional lamp holder assembly 10 comprising a housing 12 having a longitudinally extending central body 14. Radial arms 16 and 18 are attached to body 14 and project transversely therefrom. The terminal ends 20 and 22 respectively of the arms 16 and 18 are formed to receive and hold a circular lamp 24, which can be of the fluorescent variety.

The body 14 can be hollow and contain therewithin a ballast for the lamp, which ballast can comprise a transformer 26, glow bottle 28 and capacitor 30 together with the requisite wiring connecting the same to a plug 32 (for connecting to the terminals of lamp 24) and the lamp base 34. The lamp base 34 is fixed to a lower portion 36 of body 14 in a manner to allow a limited amount of rotational movement of the base 34 relative to the lowr portion 36.

One manner of accomplishing this desired result is shown in FIGS. 3–6. By referring to FIG. 3, it will be seen that lower portion 36 is provided with screw threads 38 for receiving the electrically conductive shell of base 34 which can be, for example, an Edison base.

Peripheral slots 40, 42 and 44 are formed in lower portion 36 above the threads 38, and a small notch 46 is formed in the upper edge of the base 34.

The base 34 is screwed into lower portion 36 so that slot 42 and notch 46 are aligned. One of the base connecting wires, for example 48, projects through the slot 42 and is soldered to base 34. The other base connecting wire, 50, projects through the bottom of base 34 and is soldered to the insulated center conductor 51 thereof. Both connecting wires should be sufficiently long to accommodate the programmed rotational movement without breaking.

Figure 4:
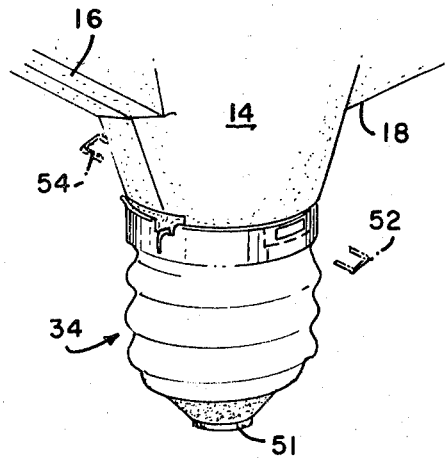
FIG. 4 is a perspective view of a partially assembled base.
Figure 6:
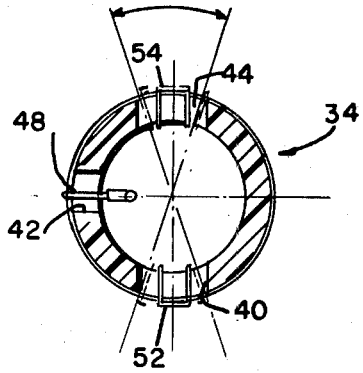
FIG. 6 is a sectional view of a base illustrating the degree of relative movement of the base.

In a preferred embodiment the limited rotational movement is achieved by driving pins 52 and 54 through the skin of the base 34 and into the slots 40 and 44 (see FIGS. 4 and 6). The pins 52 and 54 can be in the form of staples, as shown, or they can have a more nail-like configuration.

As can be seen most clearly in FIG. 6, the difference between the width of the pins 52 and 54 and the slots 40 and 44 will determine the amount of rotational movement available, which should be about 15°.

Figure 5:
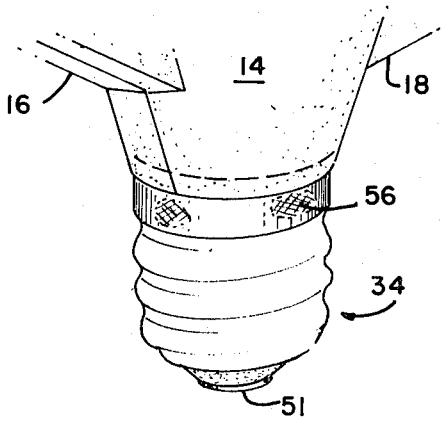
FIG. 5 is a perspective view of an assembled base.

To insure the integrity of the rotation permitting means, the pins 52 and 54 are preferably soldered to the base 34, as at 56 (FIG. 5).

The amount of rotational movement allowed by the variably positionable base 34, together with the normal amount of connecting tolerance existing in lamp sockets insures that the lamp holder 10 can be employed in harp bearing lamp units and that mounting clearance for the harp relative to the arms 16 and 18 can be achieved.

While there have been shown and described what are at present considered to be the preferred embodiments of the invention, it will be apparent to those skilled in the art that various changes and modifications can be made herein without departing from the scope of the invention as defined by the appended claims. For example, the invention is applicable to bases other than the Edison screw types, such as bayonet bases.

We claim:

1. A variably positional lamp holder assembly comprising: a housing having a longitudinal extending central body with a plurality of radial arms attached thereto and transversely projecting therefrom, the terminal ends of said arms remote from said housing being formed to receive and hold a circular fluorescent lamp; said body having a lower portion carrying an electrically conductive base, said base being fixed to said lower portion in a manner to allow a limited amount of rotational movement of said base relative to said lower portion.

2. The assembly of claim 1 wherein said manner of allowing said limited amount of rotational movement comprises: a circumferentially extending slot formed in said lower portion and a pin fixed on said base which projects into said slot.

3. The assembly of claim 2 wherein said lower portion is provided with screw threads and said base has an internal thread which mates therewith.

4. The assembly of claim 3 wherein said base has external screw threads.

5. The assembly of claim 1 wherein said manner of allowing said limited amount of rotational movement comprises: two diametrically opposed circumferentially extending slots formed in said lower portion and two diametrically opposed pins fixed on said base, each of said pins projecting into one of said slots.

6. The assembly of claim 5 wherein the length of said slots determines the amount of rotational movement of said base.

* * * * *